US008324437B2

(12) United States Patent
Hemighaus et al.

(10) Patent No.: US 8,324,437 B2
(45) Date of Patent: Dec. 4, 2012

(54) HIGH OCTANE AVIATION FUEL COMPOSITION

(75) Inventors: Gregory Hemighaus, Richmond, CA (US); William Cannella, Orinda, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 214 days.

(21) Appl. No.: 12/970,685

(22) Filed: Dec. 16, 2010

(65) Prior Publication Data

US 2012/0029251 A1 Feb. 2, 2012

Related U.S. Application Data

(60) Provisional application No. 61/368,342, filed on Jul. 28, 2010.

(51) Int. Cl.
*C10L 1/04* (2006.01)

(52) U.S. Cl. ..... 585/14; 208/15; 208/16; 208/17; 44/300

(58) Field of Classification Search ..... 44/300; 585/14; 208/15–17
See application file for complete search history.

(56) References Cited

U.S. PATENT DOCUMENTS

| | | | | |
|---|---|---|---|---|
| 2,593,561 | A * | 4/1952 | Herbst et al. | 44/454 |
| 4,294,587 | A | 10/1981 | Burns | |
| 4,695,292 | A | 9/1987 | Osborg | |
| 4,897,087 | A | 1/1990 | Blain et al. | |
| 5,208,402 | A * | 5/1993 | Wilson | 585/1 |
| 5,470,358 | A | 11/1995 | Gaughan | |
| 5,851,241 | A | 12/1998 | Studzinski et al. | |
| 5,891,202 | A | 4/1999 | Barratt et al. | |
| 5,925,152 | A | 7/1999 | Barratt et al. | |
| 5,948,126 | A | 9/1999 | Barratt et al. | |
| 6,187,064 | B1 | 2/2001 | Henderson | |
| 6,238,446 | B1 | 5/2001 | Henderson | |
| 6,258,134 | B1 | 7/2001 | Studzinski et al. | |
| 6,451,075 | B1 | 9/2002 | Schoppe et al. | |
| 6,565,617 | B2 | 5/2003 | Kalghatgi | |
| 6,767,372 | B2 | 7/2004 | Barnes et al. | |
| 6,858,048 | B1 | 2/2005 | Jimeson et al. | |
| 7,416,568 | B2 | 8/2008 | Clark | |
| 7,462,207 | B2 | 12/2008 | Clark | |
| 7,553,404 | B2 | 6/2009 | Clark et al. | |
| 2002/0005008 | A1 | 1/2002 | Studzinski et al. | |
| 2002/0045785 | A1 * | 4/2002 | Bazzani et al. | 585/14 |
| 2002/0055663 | A1 | 5/2002 | Barnes et al. | |
| 2003/0000131 | A1 | 1/2003 | Henry, Jr. et al. | |
| 2003/0040650 | A1 | 2/2003 | Butler et al. | |
| 2003/0183554 | A1 | 10/2003 | Bazzani et al. | |
| 2004/0124122 | A1 | 7/2004 | Clark | |
| 2005/0044778 | A1 | 3/2005 | Orr | |
| 2005/0144834 | A1 | 7/2005 | Jimeson et al. | |

(Continued)

FOREIGN PATENT DOCUMENTS

| | | |
|---|---|---|
| EP | 1611224 | 1/2006 |

(Continued)

*Primary Examiner* — Pamela H Weiss
(74) *Attorney, Agent, or Firm* — Alan W. Klaassen; Terrence Flaherty

(57) ABSTRACT

An unleaded aviation fuel composition, containing at least one saturated branched aliphatic hydrocarbon having a carbon number in the $C_4$ to $C_{10}$ range, further contains sufficient m-xylene to yield a fuel having a MON of at least 98. A process is further provided for producing the unleaded aviation fuel composition by admixing a m-xylene enriched liquid with alkylate.

17 Claims, 2 Drawing Sheets

U.S. PATENT DOCUMENTS

| | | | |
|---|---|---|---|
| 2005/0229480 | A1 | 10/2005 | Gaughan et al. |
| 2006/0052650 | A1 | 3/2006 | Thebault et al. |
| 2006/0086040 | A1 | 4/2006 | De Oliveira et al. |
| 2006/0123696 | A1 | 6/2006 | Gaughan et al. |
| 2006/0225340 | A1 | 10/2006 | Gaughan et al. |
| 2006/0288635 | A1 | 12/2006 | Seyfried |
| 2007/0033859 | A1 | 2/2007 | Ketley et al. |
| 2007/0215519 | A1 | 9/2007 | Dierickx |
| 2008/0134571 | A1 | 6/2008 | Landschof et al. |
| 2008/0168706 | A1 | 7/2008 | Rusek et al. |
| 2008/0172931 | A1 | 7/2008 | Bazzani et al. |
| 2008/0178519 | A1 | 7/2008 | Bazzani et al. |
| 2008/0244961 | A1 | 10/2008 | Rusek et al. |
| 2008/0244963 | A1 | 10/2008 | Demoment et al. |
| 2008/0289250 | A1 | 11/2008 | Bazzani et al. |
| 2008/0295388 | A1 | 12/2008 | Bazzani et al. |
| 2009/0229172 | A1 | 9/2009 | Brady et al. |
| 2009/0229173 | A1 | 9/2009 | Gosling |

FOREIGN PATENT DOCUMENTS

| | | |
|---|---|---|
| WO | WO9822556 | 5/1998 |
| WO | WO9949003 | 9/1999 |
| WO | WO2006026657 | 3/2006 |
| WO | WO2006060364 | 6/2006 |
| WO | WO2010004395 | 1/2010 |

* cited by examiner

MON of Aromatic Blends

Relative MON of Aromatic Blends

HIGH OCTANE AVIATION FUEL COMPOSITION

This application claims priority to U.S. Provisional Ser. No. 61/368,342, filed Jul. 28, 2010, the entire disclosure of which is incorporated herein by reference for all purposes.

FIELD OF THE INVENTION

The present invention relates to fuels, particularly aviation gasoline (aviation fuel) formulations, which contain reduced amounts of tetraethyl lead.

BACKGROUND

Aviation gasoline (aviation fuel) generally contains an aviation alkylate base fuel and a lead-based additive package. A conventional aviation fuel formulation contains light alkylate, toluene, $C_4$ to $C_5$ paraffins and tetraethyl lead. Current formulations comprise 75-92 vol. % light alkylate, 5-18 vol. % toluene, 3-20 vol. % $C_4$ to $C_5$ paraffins and 2-4 ml/gallon tetraethyl lead (TEL). The industry standard Grade 100 aviation gasoline contains up to 4 ml of TEL/gallon of fuel while Grade 100LL (low lead) aviation gasoline contains up to 2 ml TEL/gallon of fuel. Tetraethyl lead is conventionally added as an octane booster to improve the anti-knock properties of the aviation fuel over the anti-knock properties of the aviation alkylate base fuel. Specifications for aviation gasoline are detailed in ASTM D910-07a. Grade 100 aviation gasoline and Grade 100LL aviation gasoline are two grades of aviation gasoline having properties described by the specification.

The use of tetraethyl lead in fuels, particularly in automotive gasolines, has been restricted for many years due, in part, to health and environmental concerns as well as catalyst poisoning effects in automobile catalytic converters. Aviation gasolines have been allowed to contain tetraethyl lead since no suitable substitute has been found with adequate knock resistance to allow the current fleet of aircraft engines to operate properly. Current U.S. regulations set a maximum amount of tetraethyl lead in aviation fuels at 4.0 ml TEL/gallon. The continued use of tetraethyl lead nonetheless remains an environmental and health concern which has not been completely resolved. The possibility of further restrictions, or a prohibition, on the use of tetraethyl lead in aviation gasolines therefore exists.

Alternatives to the use of tetraethyl lead are known. For example, methylcyclopentadienyl manganese tricarbonyl (MMT) has been used as an antiknock agent in motor fuels since around 1975, first as a supplement to leaded agents, and then as a replacement to produce lead-free gasoline. However, questions have also been raised concerning the production of undesirable emissions using MMT.

One possible option is to hydrogenate di-isobutylene to form a mixture of isoparaffins, predominately 2,2,4-trimethylpentane or "iso-octane." Iso-octane derived from such a process may then be used to form a suitable aviation gasoline composition.

Aromatic amines and alkyl ethers have been proposed as substitutes for tetraethyl lead. These also have been found to have environmental and performance limitations as aviation gasoline additives.

In view of the current limitations placed on the use of tetraethyl lead it is desirable to produce aviation fuel compositions which contain reduced levels of lead, or do not require the presence of lead-based additives.

SUMMARY OF THE INVENTION

Accordingly, an aviation fuel composition is provided which is free of added lead and has a MON of at least 98 and which includes a m-xylene admixture with at least one saturated branched aliphatic hydrocarbon having a carbon number in the $C_4$ to $C_{10}$ range.

In addition, a process is provided for producing an unleaded aviation fuel composition comprising admixing m-xylene with at least one saturated branched aliphatic hydrocarbon having a carbon number in the $C_4$ to $C_{10}$ range to yield an aviation fuel having an MON of at least 98.

DETAILED DESCRIPTION OF THE INVENTION

Figure 1:
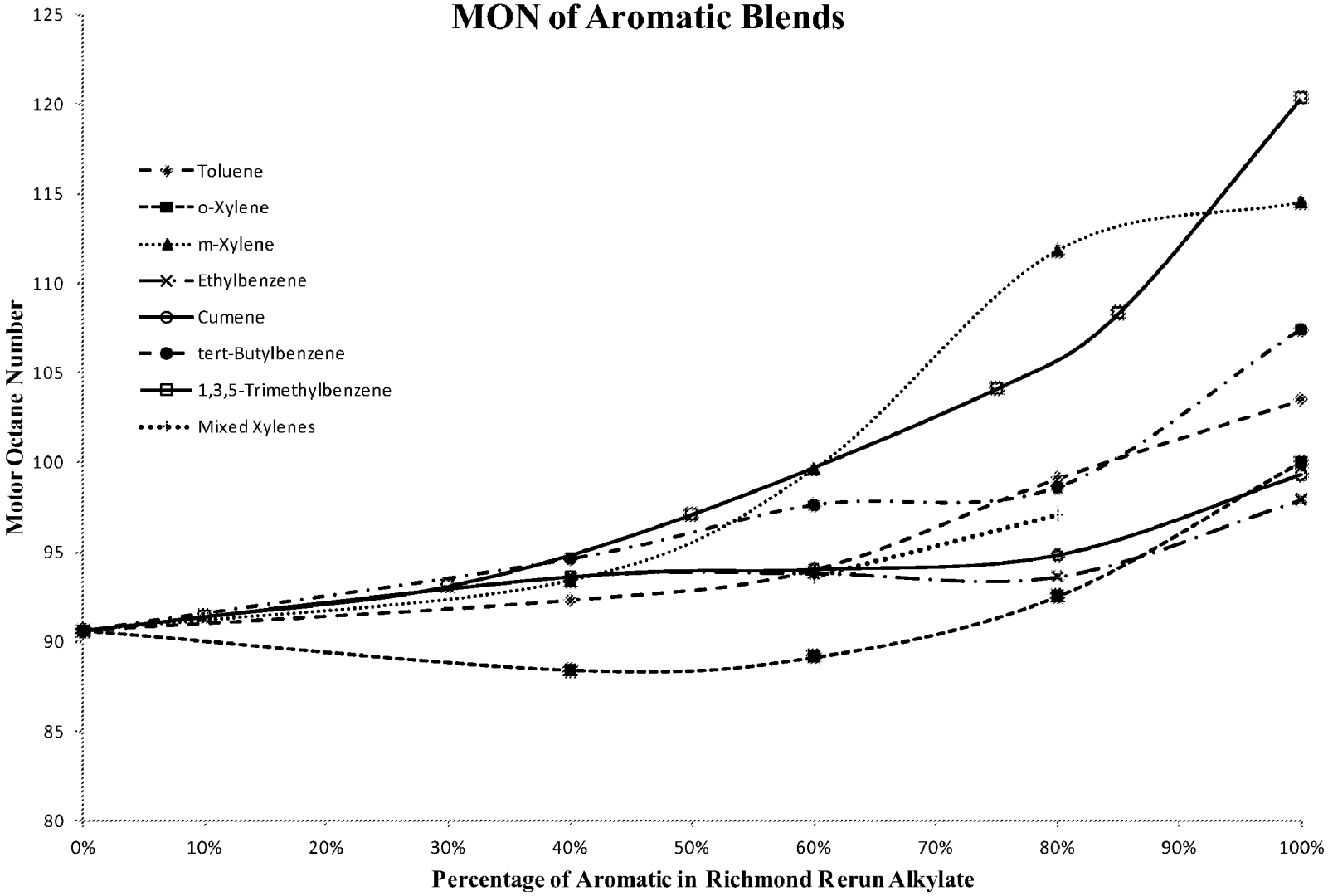
FIG. 1 shows data illustrating the change in MON of a representative aviation gasoline with varying amounts and types of aromatics added.

The present invention provides an aviation fuel composition possessing a high motor octane number (MON). The fuel composition is substantially free of added lead; in some embodiments, the composition is free of lead; and in some embodiments, the composition contains no added tetraethyl lead. In embodiments, the aviation fuel composition meets or exceeds the specification of ASTM D910-07a: *Standard Specification for Aviation Gasolines*. In some such embodiments, the aviation fuel composition is suitable as a substitute for Grade 100LL aviation fuel, as outlined by the specification.

The term "aviation gasoline" or, in the alternative, "aviation fuel" is intended to refer to gasoline possessing specific properties suitable for fueling aircraft powered by reciprocating gasoline spark ignition engines.

The terms "motor octane number" and "research octane number" are well known in the fuel art. As is further known in the art, aviation fuels are characterized according to the motor octane number (MON); automotive fuels are characterized by MON and, in the United States, the sum of the research octane number (RON) and MON divided by 2, i.e. (RON+MON)/2. As used herein, the term "motor octane number" is referenced to ASTM D2700-09; the term "research octane number" is referenced to ASTM D2699-09.

The phrase "high motor octane number" is intended to refer to a motor octane number which is within one of the following range: at least 96; or at least 98; or at least 100.

As used herein, the terms "hydrocarbon" or "hydrocarbonaceous" or "petroleum" are used interchangeably to refer to carbonaceous material originating from crude oil, natural gas or biological processes.

As used herein, "paraffin" refers to a linear or branched saturated hydrocarbon. For example, a $C_8$ paraffin is a linear or branched hydrocarbon having 8 carbon atoms per molecule. Normal octane, methylheptanes, dimethylhexanes, trimethylpentanes are examples of $C_8$ paraffins. A paraffin-containing feed comprises saturated hydrocarbons, such as normal paraffins, isoparaffins, and mixtures thereof.

An aliphatic hydrocarbon is characterized as a molecule of hydrogen atoms and carbon atoms joined together in straight chains, branched chains, or non-aromatic rings, and joined by single bonds, double bonds, or triple bonds. A saturated hydrocarbon is characterized by carbon atoms solely joined together by single bonds. A saturated hydrocarbon having a carbon number of $C_4$ is characterized as having 4 carbon atoms per molecule. Representative examples of $C_4$ hydrocarbons include n-butane and methylpropane. A saturated hydrocarbon having a carbon number of $C_{10}$ is characterized as having 10 carbon atoms per molecule. There are a large number of $C_{10}$ isomers, including n-decane and methyl-, ethyl- and propyl-substituted isomers. A hydrocarbon having a carbon number in the $C_4$ to $C_{10}$ range is characterized as having between 4 and 10 carbon atoms per molecule.

As used herein, a branched hydrocarbon contains short hydrocarbon substituents (e.g. $C_1$-$C_3$ substituents) providing branches along a longer carbon chain. For example, 2-methylbutane has a single methyl branch on the second carbon of a four carbon chain. A saturated branched aliphatic hydrocarbon is composed of hydrogen atoms, and carbon atoms joined by single bonds into chains of atoms and comprising at least one branching substituent. A non-limiting exemplary saturated branched aliphatic hydrocarbon is 2,2,4-trimethylpentane. A liquid hydrocarbon is characterized as a hydrocarbon that is a liquid at ambient temperature and pressure.

As disclosed herein, carbon number values (i.e. $C_5$, $C_6$, $C_8$, $C_9$ and the like) of hydrocarbons may be determined by standard gas chromatography methods.

As used herein, the terms p-xylene, para-xylene, and PX are used interchangeably to represent the para-isomer of xylene. In like matter, the terms m-xylene, meta-xylene, and MX are used interchangeably to represent the meta-isomer of xylene; and the terms o-xylene, ortho-xylene, and OX are used interchangeably to represent the ortho-isomer of xylene.

As used herein, the term "to admix" refers to adding as an ingredient; and the term "admixture" refers to something added as an ingredient.

As disclosed herein, boiling point temperatures and boiling point temperature ranges are based on the ASTM D-86 standard test method for boiling range distribution of petroleum fractions by gas chromatography, unless otherwise indicated. The mid-boiling point is defined as the 50% by volume boiling temperature, based on an ASTM D-86 distillation.

Unless otherwise indicated, the phrase "substantially free of" is intended to mean that a particular specified component is not purposely added to the aviation fuel composition. In embodiments, on a weight basis, "substantially free of" means that less than 0.3 wt. %; or less than 0.15 wt. %; or less than 0.05 wt. % of a particular compound is present in the blended aviation gasoline composition. In embodiments, on a volume basis, "substantially free of" means that less than 0.3 vol. %; or less than 0.15 vol. %; or less than 0.05 vol. % of a particular compound is present in the blended aviation gasoline composition.

With respect to tetraethyl lead and other lead-based additives, "substantially free of" is intended to mean that less than 0.1 ml/gallon; or less than 0.05 ml/gallon of tetraethyl lead and/or such additives are present in the blended aviation gasoline composition.

With respect to ether compounds, such as MTBE, ethyl t-butyl ether (ETBE) and t-amyl methyl ether (TAME), "substantially free of" is intended to mean that less 0.3 vol. %; or less than 0.15 vol. %; or less than 0.05 vol. % is present in the composition.

The term "iso-octane" is conventionally recognized in the fuel art and herein to refer to 2,2,4-trimethylpentane. Iso-octane is further defined as having a motor octane number of 100.

The aviation fuel composition has a motor octane number of at least 98. In embodiments, the aviation fuel composition has a motor octane number in one of the following ranges: at least 99; or at least 100; or from 101 to 111; or from 102 to 110.

In embodiments, the aviation fuel composition contains an amount of m-xylene within one of the following ranges: at least 10 wt. % m-xylene; or at least 30 wt. % m-xylene; or at least 50 wt. % m-xylene; or at least 60 wt. % m-xylene; or in the range of from 70 wt. % to 90 wt. % m-xylene. In embodiments, the aviation fuel composition contains less than 10 wt. % p-xylene or less than 5 wt. % p-xylene. Likewise, in embodiments the aviation fuel composition contains less than 10 wt. % o-xylene or less than 5 wt. % o-xylene.

The m-xylene may be recovered, for example, as a component of a reformate from a reforming process.

Reforming is a chemical reaction of liquid feed materials, including hydrocarbons, petroleum and other biological derived material, in the presence of one or more catalysts, resulting in high octane products, including, for example, aviation fuel, automobile fuel, aromatics (for example benzene, toluene, xylenes and ethylbenzene), as well as hydrogen. Reactions involved in catalytic reforming include dehydrocylization, isomerization and dehydrogenation of naphtha range hydrocarbons, with dehydrocyclization and dehydrogenation of linear and slightly branched alkanes and dehydrogenation of cycloparaffins leading to the production of aromatics.

Reforming is generally a catalytic process for increasing the octane of a naphtha boiling range feed with the associated generation of hydrogen. The catalysts may be employed in the form of pills, pellets, granules, broken fragments, or various special shapes, disposed as a fixed bed within a reaction zone, through which the charging stock may be passed in the liquid, vapor, or mixed phase, and in either upward, downward or radial flow. Alternatively, they can be used in moving beds or in fluidized-solid processes, in which the charging stock is passed upward through a turbulent bed of finely divided catalyst. In a fixed bed system, the feed is preheated (by any suitable heating means) to the desired reaction temperature and then passed into a reaction zone containing a fixed bed of the catalyst. This reaction zone may be one or more separate reactors with suitable means to maintain the desired temperature at the reactor entrance. The temperature must be maintained because reforming reactions are or endothermic in nature.

The reforming catalyst may be any catalyst known to have catalytic reforming activity. In embodiments, the catalyst comprises a Group VIII metal disposed on an oxide support. Example Group VIII metals include platinum and palladium. The catalyst may further comprise a promoter, such as rhenium, tin, germanium, cobalt, nickel, iridium, tungsten, rhodium, ruthenium, or combinations thereof. In some such embodiments, the promoter metal is rhenium or tin. These metals are disposed on a support, such as alumina, silica/alumina, or silica. In some such embodiments, the support is alumina. The support may also include natural or man-made zeolites. The catalyst may also include between 0.1 and 3 weight percent chloride, preferably between 0.5 and 1.5 weight percent chloride. The catalyst, if it includes a promoter metal, suitably includes sufficient promoter metal to provide a promoter to platinum ratio between 0.5:1 and 10:1 or between 1:1 and 6:1.

Reforming reaction conditions include a temperature in the range from about 800° F. to about 1100° F., a pressure in the range from greater than 70 psig to about 400 psig, and a feed rate in the range of from about 0.5 $hr^{-1}$ to about 5 $hr^{-1}$ LHSV. In some embodiments, the pressure is in the range from about 200 psig to about 400 psig.

The high octane reformate that is recovered from the reforming process is suitable for use in the aviation fuel composition. The high octane reformate has a MON of greater than 80. In embodiments, the high octane reformate has a MON in one of the following ranges: from 80 to 97; or from 83 to 97; or from 85 to 97; or from 87 to 95.

The high octane reformate has a boiling point range within the range of from 0° C. to 300° C. In embodiments, the high octane reformate has a boiling within the range of from 25° C. to 250° C., or within the range of 30° C. to 230° C.

The aviation fuel composition further comprises at least one saturated branched aliphatic hydrocarbon. In embodiments, the aviation fuel composition contains an amount of the saturated branched aliphatic hydrocarbon within one of the following ranges: at most 50 wt. %; or at most 40 wt. %; or within the range of 10 wt. % to 30 wt. % of the saturated branched aliphatic hydrocarbon, based on the total aviation fuel composition.

The saturated, branched aliphatic hydrocarbon is generally in the $C_4$ to $C_{12}$ range. In embodiments, the saturated, branched aliphatic hydrocarbon is in the $C_4$ to $C_{10}$ range, or in the $C_4$ to $C_9$ range, or in the $C_6$ to $C_9$ range. In embodiments, at least 85 wt. %, or at least 90 wt. %, or at least 95 wt. % of the saturated branched aliphatic hydrocarbon is in the $C_4$ to $C_{10}$ range; or in the $C_4$ to $C_9$ range; or in the $C_6$ to $C_9$ range. In some such embodiments, between 95 wt. % to 99.9 wt. % of the hydrocarbon is in the $C_4$ to $C_{10}$ range. In some such embodiments, between 95 wt. % to 99.9 wt. % of the hydrocarbon is in the $C_6$ to $C_9$ range. In some such embodiments, at least 40 wt. %; or at least 50 wt. % is in the $C_8$ range.

The saturated branched aliphatic hydrocarbon generally has a boiling point within the range of from 0° C. to 220° C. In embodiments, it has a boiling point within the range of 0° to 175° C., or within the range of 50° C. to 175° C. In some such embodiments, at least 85 vol. % of the saturated branched aliphatic hydrocarbon has a boiling point in the range of 0° C. to 220° C., or in the range of 20° C. to 175° C., or in the range of 50° C. to 175° C.; in embodiments, between 85 vol. % to 99.9 vol. % of the saturated branched aliphatic hydrocarbon has a boiling point in the range of 50° C. to 175° C.

The saturated branched aliphatic hydrocarbon has a MON of at least 80. In embodiments, the saturated branched aliphatic hydrocarbon has a MON in one of the following ranges: in the range of 80 to 101; or in the range of 83 to 101, or in the range of 85 to 100, or in the range of 87 to 100, or in the range of 91 to 100.

In embodiments, the aviation fuel composition contains an m-xylene admixture with naphtha, the naphtha comprising the saturated branched aliphatic hydrocarbon. Naphtha is a distillate hydrocarbonaceous fraction that is generally one of the important products generated during petroleum refining operations. Naphtha can include, for example, straight run naphthas, paraffinic raffinates from aromatic extraction or adsorption, $C_4$-$C_{10}$ paraffin containing feeds, bioderived naphtha, naphtha from hydrocarbon synthesis processes, including Fischer Tropsch and methanol synthesis processes, as well as naphtha from other refinery processes, such as hydrocracking or reforming or alkylation.

Naphtha has a boiling point range within the range of from 0° C. to 300° C. In embodiments, naphtha has a boiling point range within the range of 25° C. to 250° C.; or within the range of 30° C. to 230° C.

In general, naphtha comprises a range of molecular types, such as, for example, one or more of linear, branched and cyclic paraffins; linear, branched and cyclic olefins; aromatics; and oxygenates. Among the aromatics that might be found in naphtha includes benzene and its methyl-, ethyl- and propyl-substituted analogs, e.g. benzene, toluene, ortho-xylene, meta-xylene, para-xylene and 1,3,5-trimethylbenzene. In an embodiment, the naphtha comprises at least one saturated liquid aliphatic hydrocarbon.

The naphtha has a MON of greater than 80. In embodiments, naphtha has a MON in one of the following ranges: greater than 85, or greater than 90. In embodiments, the naphtha has a MON in one of the following ranges: in the range of 80 to 97; or in the range of 83 to 97; or in the range of 85 to 97; or in the range of 87 to 95.

In embodiments, the aviation fuel composition comprises an m-xylene admixture with alkylate, the alkylate comprising a saturated branched aliphatic hydrocarbon.

In embodiments, the aviation fuel composition contains an amount of alkylate within one of the following ranges: at most 50 wt. %; or at most 40 wt. %; or within the range of 10 wt. % to 30 wt. % of alkylate.

Alkylate is a highly paraffinic hydrocarbon liquid that contains at least 75 wt. % saturated, branched aliphatic hydrocarbon. In terms of carbon number, alkylate is in the $C_4$ to $C_{12}$ range. In embodiments, alkylate is in the $C_4$ to $C_{10}$ range, or in the $C_4$ to $C_9$ range, or in the $C_6$ to $C_9$ range. In some embodiments, at least 80 wt. % of alkylate, or at least 85 wt. % of alkylate, or at least 90 wt. % of alkylate is saturated branched aliphatic hydrocarbon in the $C_4$ to $C_{10}$ range; or in the $C_4$ to $C_9$ range; or in the $C_6$ to $C_9$ range. In some such embodiments, between 95 wt. % and 99.9 wt. % of alkylate is saturated branched aliphatic hydrocarbon in the $C_4$ to $C_{10}$ range. In some such embodiments, at least 40 wt. %; or at least 50 wt. % of the saturated branched aliphatic hydrocarbon is in the $C_8$ range. In one embodiment, trimethylpentane isomers are the major products of alkylation, with at least 20 wt. %, or at least 40 wt. %, or at least 50 wt. % of alkylate being one or more trimethylpentane isomers. 2,2,4-trimethylpentane is an illustrative trimethylpentane isomer.

In some such embodiments, alkylate contains less than 5 wt. %; or less than 2 wt. %; or less than 1 wt. %; or less than 0.5 wt. % $C_8$ aromatics.

Alkylate has a MON of at least 80. In embodiments, alkylate has a MON in at least one of the following ranges: in the range of 80 to 99; or in the range of 80 to 97; or in the range of 83 to 97; or in the range of 85 to 97; or in the range of 87 to 95.

In general, alkylate boils in the range of 15° C. to 200° C. range or in any range therebetween. An exemplary alkylate for aviation fuel boils in the range of 25° C. to 150° C.; or in the range of 30° C. to 140° C.; or in the range of 45° C. to 120° C. In some such embodiments, at least 85 vol. % of alkylate boils in the range of 25° C. to 150° C.; or in the range of 30° C. to 140° C.; or in the range of 45° C. to 120° C.

Alkylate may be produced in an alkylation unit in an oil refinery. For example, an alkylate may be produced using HF, $H_2SO_4$, or an ionic liquid as a catalyst, the catalyst being used to promote the conversion of small paraffins and olefins to relatively larger saturated, branched aliphatic hydrocarbon. Alkylate produced from an alkylation unit using hydrogen fluoride catalyst contains at least 75%, or at least 80%, or at least 85%, or at least 90% saturated, branched aliphatic hydrocarbon, the remainder usually being other organic compounds, e.g., straight chain paraffins, aromatics, etc. Impurity levels in typical alkylates are low.

In some embodiments, the aviation fuel composition includes low boiling paraffins in sufficient quantity to meet the vapor pressure requirements of the specification. Exemplary low boiling paraffins, such as n-butane and n-pentane, which may be included for vapor pressure control, may be supplied in a straight run or FCC naphtha fraction. Isobutane and isopentane may be supplied in an alkylate fraction.

The aviation fuel composition may also comprise certain additives which are approved for aviation fuels. In particular, additives such as color dyes, anti-lead deposit formation compounds, oxidation inhibitors, corrosion inhibitors, fuel system icing inhibitor and static dissipater additives may also be added, as well as other conventional aviation fuel additives.

In one embodiment, the aviation fuel composition is substantially free of ether compounds, including alkyl tertiary butyl ether compounds, such as methyl tertiary butyl ether or ethyl tertiary butyl ether. In an embodiment, the aviation fuel composition is substantially free of amine compounds, including aliphatic or aromatic amine compounds. In an embodiment, the aviation fuel composition is substantially free of tri-isobutylene and/or other isomers of $C_{12}$ isoparaffins.

The aviation fuel composition has a very low lead content. In some embodiments, the fuel composition is substantially free of lead; in some embodiments, the composition is free of lead; and in some embodiments, the composition is free of added lead, such as free of added tetraethyl lead.

The aviation fuel composition is prepared by admixing m-xylene with at least one saturated branched aliphatic hydrocarbon having a carbon number in the $C_4$ to $C_{10}$ range to yield an aviation fuel having an MON of at least 98. In embodiments, the process comprises blending the saturated branched aliphatic hydrocarbon, or a liquid containing the saturated branched aliphatic hydrocarbon, with m-xylene, or a liquid containing m-xylene, to produce an aviation fuel composition having a MON of at least 98, or at least 99, or at least 100. In embodiments, the fuel composition is prepared by blending naphtha comprising the saturated branched aliphatic hydrocarbon with m-xylene or a liquid containing m-xylene. In some such embodiments, the naphtha comprises a high octane reformate. In some such embodiments, the naphtha comprises alkylate. The m-xylene is admixed with the naphtha to result in an increase in the MON by at least 1 octane number, or by at least 3 octane numbers, or by at least 5 octane numbers, or by at least 10 octane numbers. In order to achieve the desired increase in MON, at least 10 wt. % m-xylene is admixed with the naphtha. In embodiments, at least 30 wt. %, or at least 50 wt. %, and even in the range of from 70 wt. % to 90 wt. % m-xylene is admixed with the naphtha.

The m-xylene may be supplied to the naphtha as a pure form of m-xylene or in the form of a m-xylene enriched liquid. In general, a suitable m-xylene enriched liquid comprises at least 50 wt. % m-xylene. In embodiments, the m-xylene enriched liquid comprises at least 60 wt. % m-xylene, or at least 70 wt. % m-xylene. M-xylene enriched liquids containing in the range of from 90 wt. % m-xylene to 99.9 wt. % m-xylene would be suitable for providing m-xylene for the aviation fuel composition.

Methods available for preparing m-xylene are known to the skilled practitioner. In one embodiment, m-xylene is produced during the reforming of a naphtha stream. In general, m-xylene produced during reforming is in fairly low concentrations, and additional processing may be indicated to increase the relative m-xylene concentration. For example, the m-xylene can be concentrated by fractional distillation of the reformate, by fractional crystallization or by adsorption. In embodiments, the xylene-rich stream contains para-xylene, ortho-xylene and meta-xylene in an equilibrium ratio of about 24 wt. % para-xylene, about 54 wt. % meta-xylene and about 22 wt. % ortho-xylene. In one embodiment, m-xylene is concentrated using chromatographic separation. In another embodiment, p-xylene is concentrated from the equilibrium mixture by fractional crystallization or by adsorption, which preferentially separates the para-xylene as a solid, leaving a meta-xylene enrich stream for use in the aviation fuel composition. In other embodiments, a mixed xylene product is prepared by disproportionation of toluene; recovery of a m-xylene enriched liquid proceeds as described above.

EXAMPLES

Example 1

An alkylate was analyzed, with the results of the analyses listed in Table I.

TABLE I

| Total composition | |
|---|---|
| Normal Paraffins | 1.7 wt. % |
| Iso-Paraffins | 96.9 wt. % |
| Olefins | 0.009 wt. % |
| Naphthenes | 0.68 wt. % |
| Aromatics | 0.19 wt. % |
| $C_4$ to $C_{10}$ | 99.1 wt. % |
| $C_8$ | 52.4 wt. % |
| $C_8$ composition | |
| Normal Paraffins | Not detected |
| Iso-Paraffins | 52.4 wt. % |
| Olefins | 0.002 wt. % |
| Naphthenes | 0.037 wt. % |
| Aromatics | Not detected |

Example 2

An alkylate similar to that of Example 1 (MON=90.6; 0.19 wt. % aromatics) was blended with the aromatics listed in Table II at ratios between 10% and 90% aromatic content. The resulting MON values of the blends are plotted in FIG. 1. Both meta-xylene and 1,3,5 TMB blended with the base alkylate achieve 100 MON at the lowest concentrations.

TABLE II

| Aromatic admixture | MON of Aromatic |
|---|---|
| Toluene | 103.5 |
| o-Xylene | 100 |
| m-Xylene | 114.5 |
| EthylBenzene | 97.9 |
| Cumene | 99.3 |
| Tert-butylbenzene | 107.4 |
| 1,3,5 trimethylbenzene | 120.3 |

For each admixture, the following ratio was calculated:

$$\text{Relative MON}=\text{MON}_{actual}/\text{MON}_{predicted},$$

Where:

MON, predicted=$(\text{MON}_{alkylate}+\%_{aromatic}*(\text{MON}_{aromatic}-\text{MON}_{alkylate}))\text{MON}_{alkylate}=90.6$ $\%_{aromatics}$=total amount of aromatics in the admixture, expressed as a fraction $\text{MON}_{aromatics}$=the MON of the pure aromatic, as listed in Table II.

Figure 2:
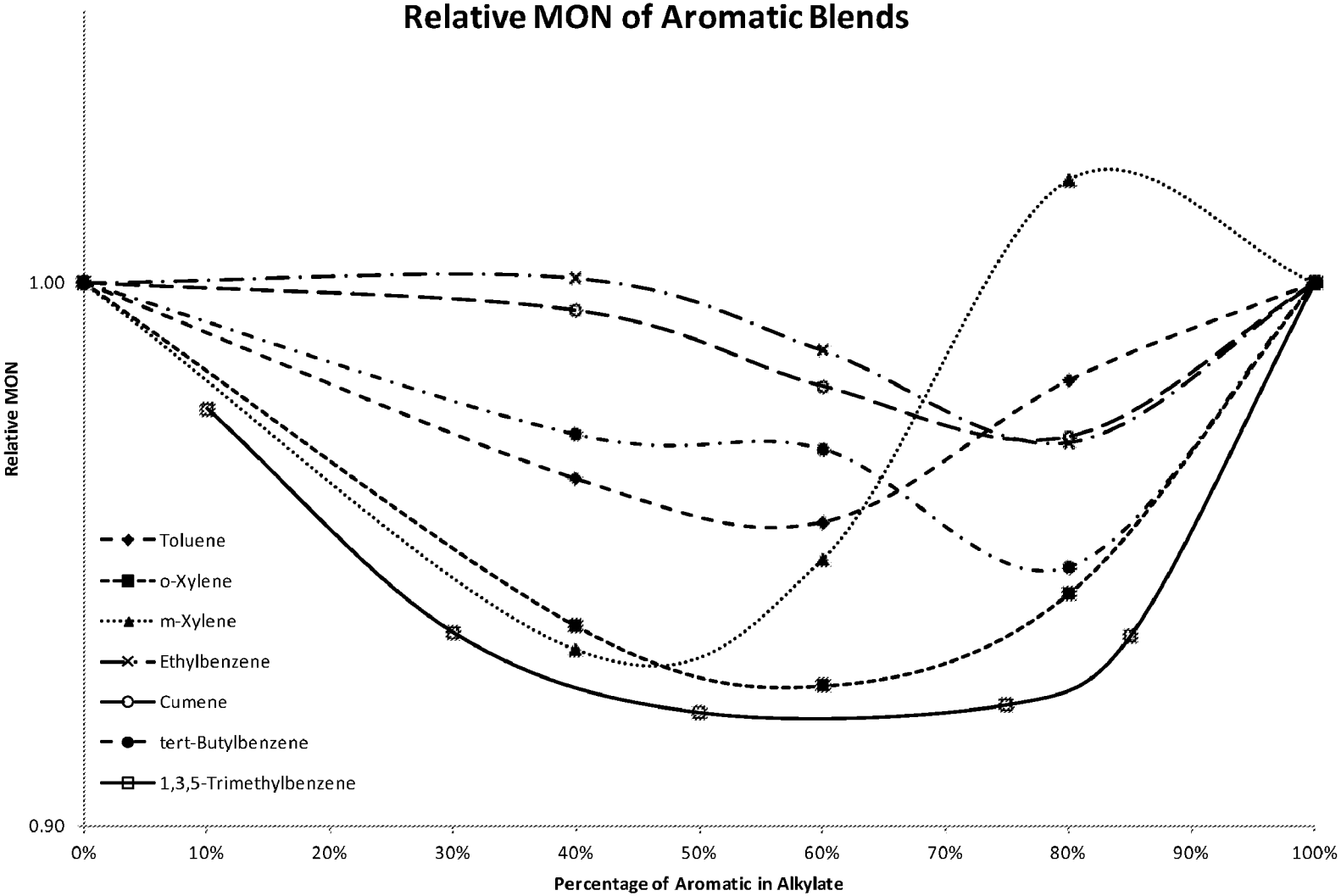
FIG. 2 shows data illustrating the change in relative MON of a representative aviation gasoline with varying amounts of aromatics added.

The results are illustrated in FIG. 2. Surprisingly, the results show that m-xylene has a very different shaped response curve from the other aromatics, including the other $C_8$ aromatic isomers (ortho-xylene, ethylbenzene), and a mixture of the xylene isomers ("mixed" xylenes). At a concentration of 40% m-xylene, surprisingly, the relative MON starts to rise sharply. Also, only m-xylene, among the aromatics tested, had a MON above that predicted from MON values of the pure components.

What is claimed is:

1. An aviation fuel composition which is free of added lead and has a MON of at least 98 and which comprises a m-xylene admixture with at least one saturated branched aliphatic hydrocarbon having a carbon number in the $C_4$ to $C_{10}$ range, wherein the fuel composition contains at least 60 wt. % m-xylene.

2. The fuel composition of claim 1, having a MON of at least 99.

3. The fuel composition of claim 1, having a MON in the range of 100 to 110.

4. The fuel composition of claim 1, which contains in the range of from 70 wt, to 90 wt. % m-xylene.

5. The fuel composition of claim 1, which contains less than 5 wt. % o-xylene.

6. The fuel composition of claim 1, wherein at least 85 wt. % of the saturated branched aliphatic hydrocarbon has a carbon number in the $C_6$ to $C_9$ range.

7. The fuel composition of claim 1, wherein the saturated branched aliphatic hydrocarbon has a MON in the range of 80 to 97.

8. The fuel composition of claim 1, wherein the saturated branched aliphatic hydrocarbon is a component of an alkylate.

9. The fuel composition of claim 8, wherein the alkylate has a MON in the range of 80 to 97.

10. The fuel composition of claim 8, wherein the alkylate boils in the range of 15° C. to 200° C.

11. The fuel composition of claim 8, wherein at least 80 wt. % of the alkylate is in the $C_4$ to $C_{10}$ hydrocarbon range.

12. The fuel composition of claim 8, wherein the alkylate comprises at least 80 wt. % saturated branched aliphatic hydrocarbon.

13. The fuel composition of claim 8, wherein the alkylate comprises at least 50 wt. % saturated branched aliphatic $C_8$ hydrocarbon.

14. The fuel composition of claim 8, wherein the alkylate comprises less than 5 wt. % $C_8$ aromatics.

15. A process for producing an unleaded aviation fuel composition comprising admixing m-xylene with at least one saturated branched aliphatic hydrocarbon having a carbon number in the $C_4$ to $C_{10}$ range to yield an aviation fuel having a MON of at least 98, wherein the fuel composition contains at least 60 wt. % m-xylene.

16. The process of claim 15, further comprising admixing a m-xylene enriched stream with alkylate.

17. The process of claim 15, further comprising admixing a m-xylene enriched stream with alkylate having a MON in the range of 80 to 97, to produce the aviation fuel having a MON that is at least 3 numbers higher than the MON of the alkylate.

* * * * *